United States Patent [19]

Ahlstone

[11] 3,933,202

[45] Jan. 20, 1976

[54] APPARATUS FOR SETTING AND LOCKING PACKING ASSEMBLIES IN WELLHEADS

[75] Inventor: Arthur G. Ahlstone, Ventura, Calif.

[73] Assignee: Vetco Offshore Industries, Inc., Ventura, Calif.

[22] Filed: Oct. 21, 1974

[21] Appl. No.: 516,173

[52] U.S. Cl. ..... 166/182; 166/.5; 166/208; 285/18

[51] Int. Cl.[2] ..... E21B 23/06; E21B 33/035; E21B 33/128

[58] Field of Search ..... 166/87, 182, 208, 115; 285/18

[56] References Cited

UNITED STATES PATENTS

| | | | |
|---|---|---|---|
| 3,382,927 | 5/1968 | Davis, Jr. | 166/208 |
| 3,543,847 | 12/1970 | Haeber | 166/208 |
| 3,827,488 | 8/1974 | Piazza et al. | 166/87 |

*Primary Examiner*—Stephen J. Novosad
*Attorney, Agent, or Firm*—Bernard Kriegel

[57] ABSTRACT

Running apparatus is releasably connected to a packing assembly, the combination being lowered on a tubular running string until the packing assembly is disposed between a hanger body and a surrounding wellhead underlying a body of water. The apparatus is responsive to weight to effect setting of the packing in the annular space between the hanger body and wellhead. Test pressure is applied to the packing and more firmly sets it. The apparatus is rotated relative to the packing to shift a locking nut to lock the packing in place, the apparatus then being retrieved to the drilling rig at the water surface.

20 Claims, 9 Drawing Figures

APPARATUS FOR SETTING AND LOCKING PACKING ASSEMBLIES IN WELLHEADS

The present invention relates to well apparatus, and more particularly to apparatus for effecting a seal in the region between a hanger body and a surrounding wellhead housing disposed at the upper end of the well bore.

In the drilling of oil and gas wells at an underwater location, a casing string is run into a well bore, the casing string being supported on a hanger body resting on a companion seat in a surrounding wellhead. The casing string is cemented in place and a suitable packing or seal assembly actuated to pack off the annular region between the hanger body and wellhead. Apparatus for performing the above method is illustrated in a number of United States patents, including Applicant's U.S. Pat. Nos. 3,468,558, 3,468,559, 3,489,436, and 3,492,026.

In general, the packing is supported upon a running and setting tool operable so that the weight of the running pipe string or a downwardly extended weight string beneath the running and setting tool initially effects longitudinal motion of the packing and deforms the packing into sealing engagement in the annular space between the hanger body and the wellhead housing. Thereafter, fluid pressure is applied to the packing via the kill or choke line of the blowout preventer above the wellhead housing to test the efficacy of the seal, and more tightly sets the packing.

The initial packoff weight is generally provided by heavy drill collars since the drill pipe, in many instances, may not have adequate weight. In other cases, the initial packoff may be effected by rotating the pipe string to drive the packing support rotatively on a threaded connection with the casing hanger body.

In the case of the present invention, the packing assembly and the locking nut are assembled on a running tool to be lowered on a running pipe string into the subsurface housing. When the packing is in place in the annular space between the wellhead housing and a previously landed casing hanger, the lock nut engages the casing hanger, and the weight of the running string and drill collars causes the packing to be deformed into sealing engagement with the housing and the hanger. During setting of the packing, it and the locking nut are released from the running tool which has keyed engagement with the locking nut to turn the nut onto the casing hanger thread by rotation of the running string.

Accordingly, the invention provides a novel and simple running and setting tool for effecting the pack off and locking of the packing in the subsurface housing.

The invention possesses many other advantages and has other purposes which may be made more clearly apparent from a consideration of a form in which it may be embodied. This form is shown in the drawings accompanying and forming a part of the present specification. It, and its method of use, will now be described in detail for the purpose of illustrating the general principles of the invention; but it is to be understood that such detailed description is not to be taken in a limiting since.

Referring to the drawings.

Figure 1:
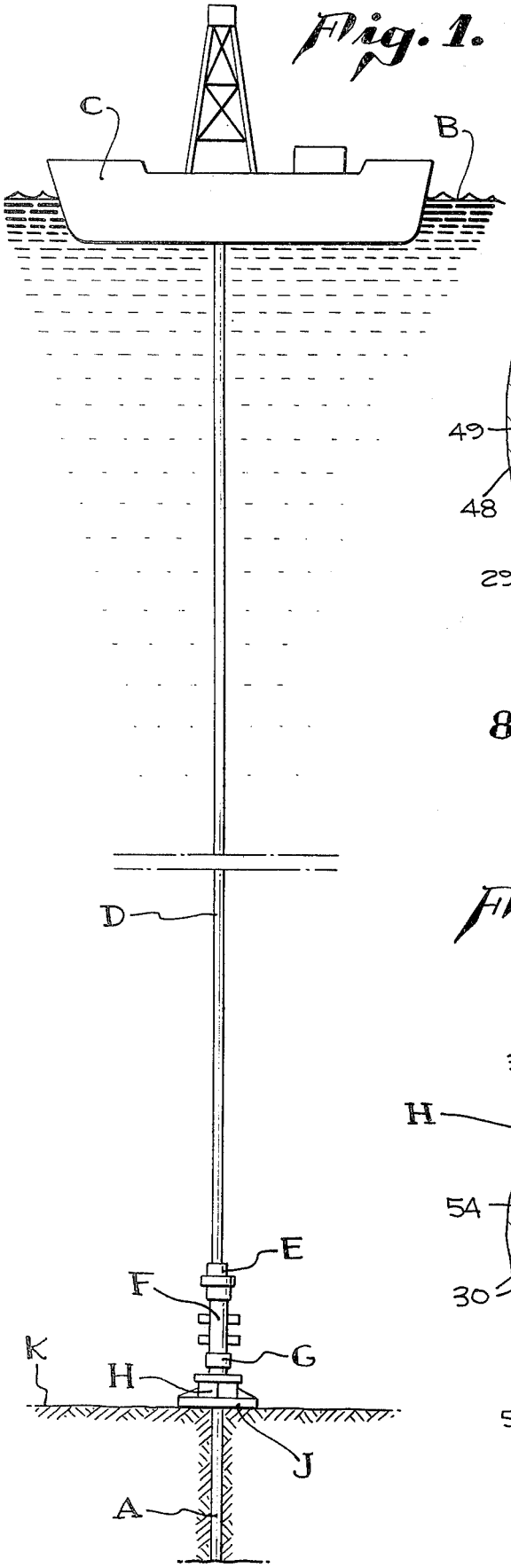
FIG. 1 is a view in elevation showing a subsurface wellhead assembly through which well completion operations are performed from a floating vessel.
Figure 6:
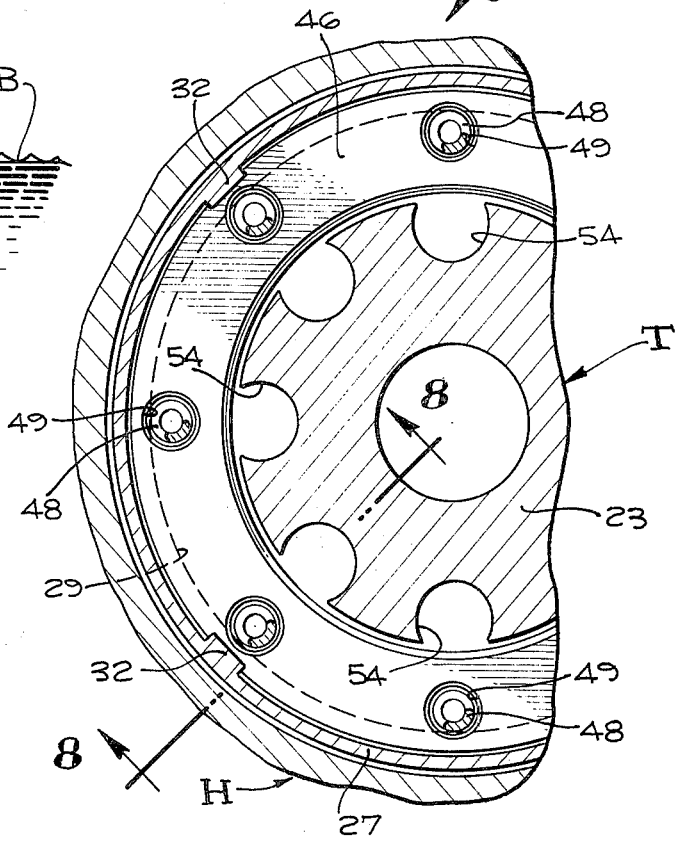
FIG. 6 is a horizontal section as taken on the line 6 through 6 of FIG. 4.
Figure 7:
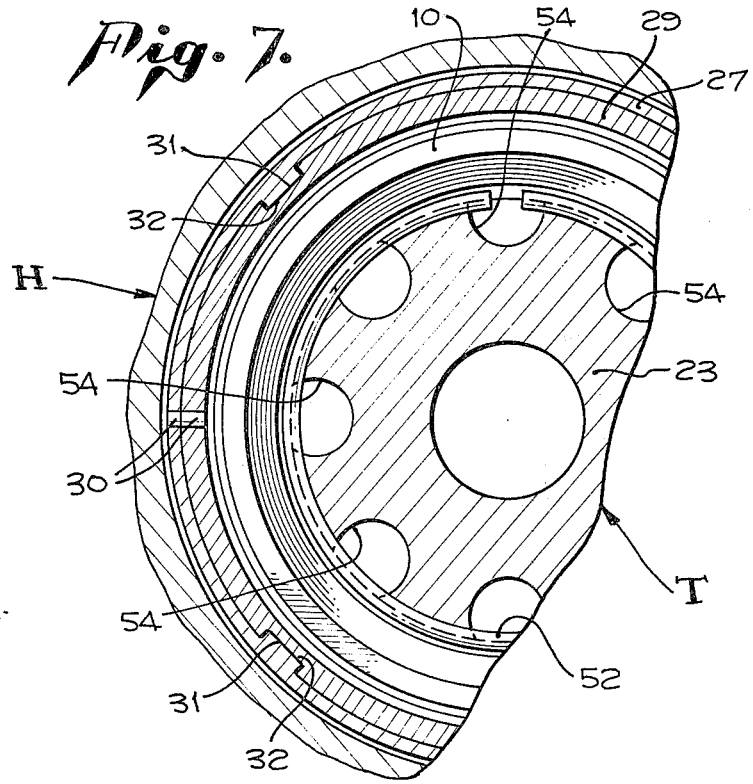
FIG. 7 is a horizontal section as taken on the line 7 through 7 of FIG. 5.

FIG. 1 is a diagrammatic illustration of a well bore A drilled below a body of water B from a drilling vessel C floating at the surface of the water, a marine riser pipe D extending from the drilling vessel downwardly to a suitable connector E attached to a blowout preventer stack F, which is connected through a suitable connector G to a wellhead housing H disposed within a base J mounted on the floor K of the body of water.

As illustrated in the drawings, a casing hanger body 10 has been lowered on a running tool T into the wellhead housing H, this body 10 having a landing ring 11, which has a tapered surface, adapted to rest upon a companion seat 12 in the wellhead housing H, in order that the hanger body can support a string of well casing M threadedly secured thereto and extending downwardly into the well bore. A split lock ring 13 is disposed adjacent to a peripheral groove 14 in the hanger housing and is adapted to be expanded outwardly to prevent upward movement of the casing string M and the hanger body 10 with respect to the wellhead housing.

Figure 2:
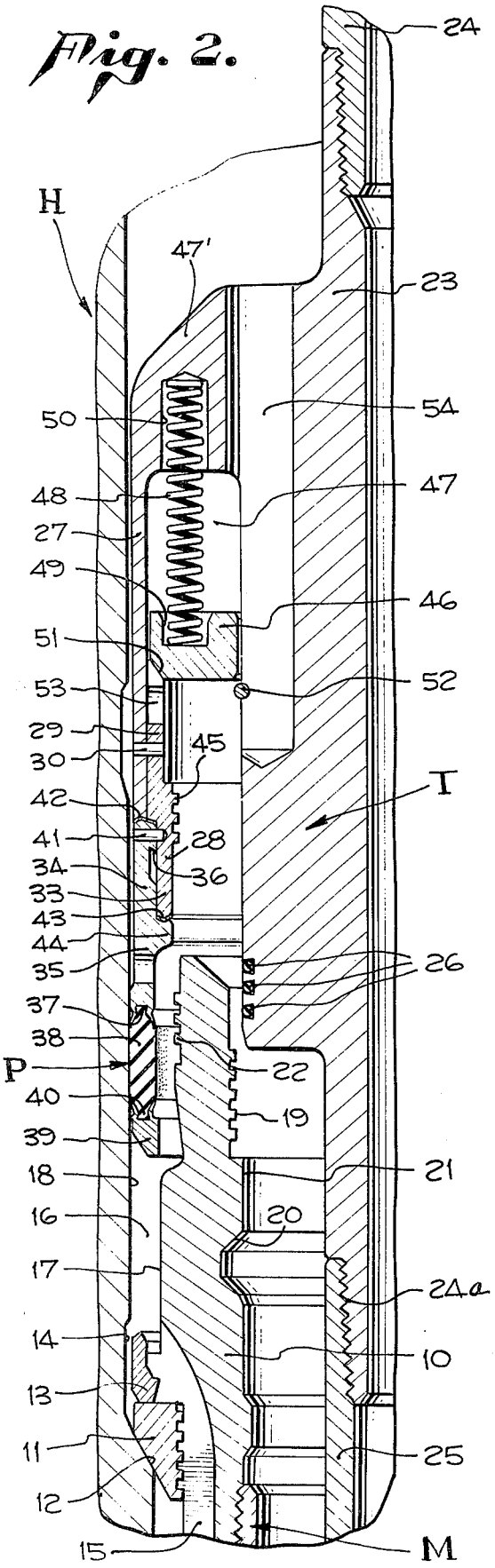
FIG. 2 is a fragmentary longitudinal section showing the packing assembly on the running tool and being lowered into the wellhead housing.

Circumferentially spaced longitudinal flow passages or grooves 15 are provided in the lower portion of the hanger body 10 to permit circulating fluid and cement slurry to flow upwardly through the interior of the landing shoulder 11 and into the annulus 16 between the hanger body 10 and wellhead housing H. The lower portion of this annulus is defined between an external peripheral surface 17 on the hanger body above the flow passages 15 and an opposed internal cylindrical sealing surface 18 in the wellhead housing. A packing assembly P is shown in FIG. 2 as having been run into the wellhead housing H on the running and setting tool T and disposed above the upper portion of the annulus 16.

It is to be noted that the casing hanger body 10 has an internal left-hand thread 19 and an internal groove 20, either of which can be operatively associated with a running tool (not shown) for lowering the hanger body 10 and casing M into the well bore and wellhead housing. Moreover, a cylindrical internal sealing surface 21 is provided in the hanger body below its threads 19 for a purpose to be described hereinbelow. It should further be noted that the upper external portion of the hanger body is provided with an external right-hand thread 22 which coacts with the packing assembly P in effecting the locking of the packing P in sealing relation against the opposed cylindrical surfaces 17, 18 on the hanger body 10 and wellhead H.

After the well casing M and hanger body 10 have been lowered into their appropriate position in the well bore and wellhead, and the circulating and cementing operations have been completed, the annular region between the external and internal sealing surfaces 17 and 18 on the casing hanger body and wellhead are to be engaged by the packing assembly P, which is releasably connected to the running and actuating tool T, which includes a body structure, the upper portion 23 of which is threadedly secured by a sub 24 to the lower end of a tubular running string by means of which the running and actuating tool and packing assembly combination are lowered toward the previously set hanger body 10 from the drilling vessel.

At the lower end of the body of the tool T is a threaded connection 24*a* with a downwardly extended pipe string 25, which may be composed of heavy drill collars to add to the weight of the running string 25 useful to set the packing assembly and seal off the annular space 16. The body also has a number of vertically spaced external seal rings 26, one or more of which is adapted to sealingly engage within the bore or sealing surface 21 in the casing hanger 10 to enable the application of test pressure to the packing P, as will be later described.

Depending from the upper tool body section 23 is an outer skirt 27. Carried by the skirt 27 are the packing means P and a locking nut 28. More particularly, the locking nut 28 has an upper cylindrical portion 29 extending into the body skirt 27 and releasably connected to the skirt leg by a number of circumferentially spaced shear pins 30. The nut section 29 and the skirt 27 have companion axially extended grooves 31 and keys 32 forming a splined connection by which the nut is actuated, as will be later described, to lock the packing in place in the annulus 16. The locking nut 28 also has a downwardly extending cylindrical section 33 received by an upper cylindrical neck 34 of a packing support sleeve 35, the neck 34 having an internal shoulder 36 enabling retrieval of the packing assembly leg by a suitable retrieving tool, not shown. The packing assembly is more particularly disclosed in U.S. Pat. No. 3,797,864, granted Mar. 18, 1974, for COMBINED METAL AND ELASTOMER SEAL. As shown, the support sleeve has a dovetailed connection 37 with an elastomeric, resiliently deformable packing sleeve 38 having a lower abutment ring 39 connected thereto by a dovetailed connection 40.

Releasable shear pin means 41 connect the packing supporting sleeve 35 to the lock nut 28, with suitable bearing inserts disposed between the parts. One bearing insert 42 is disposed between the lower end of the body skirt 27 and the upper end of the packing support sleeve 35 and between the upper nut and the support sleeve 35. The other bearing insert 43 is disposed between the lower end of the lock nut 28 and an inner thrust shoulder 44 on the packing sleeve 35.

These bearing inserts 42 and 43 reduce friction when the locking nut 28 is being rotated by the tool T to lock the packing means P in place in the annulus 16. Internally, the locking nut 28 has a thread 45 engageable with the outer thread 22 of the hanger body in response to rotation of the nut by the tool T. In order to provide a downward bias on the nut 28 to assist it to engage the thread 22 of the casing hanger, the body section 23 carries a thrust ring 46 in the annulus 47 between the body section 23 and the skirt 27. Interposed between the thrust ring 46 and the upper body flange 47' are a number of circumferentially spaced coiled compression springs 48 engaged in opposed seats 49 in the ring 46 and 50 in the body flange 47' to urge the ring 46 downwardly into engagement with the upper end 51 of the nut section 29. A stop ring 52 installed about the upper tool body section 23 initially holds the thrust ring 46 against displacement during assembly of the apparatus.

At the upper end of the lock nut section 29 are a number of J-slots 53 adapted to receive a suitable retrieving tool or a protector sleeve, as is well known.

In the use of the apparatus, the tool T, with the packing and locking means assembled therein by the shear pins 30 and 41, is lowered into the housing 14, as seen in FIG. 2. Fluid can bypass the tool through suitable circumferentially spaced longitudinal flow passages 54 in the body section 23.

Figure 3:
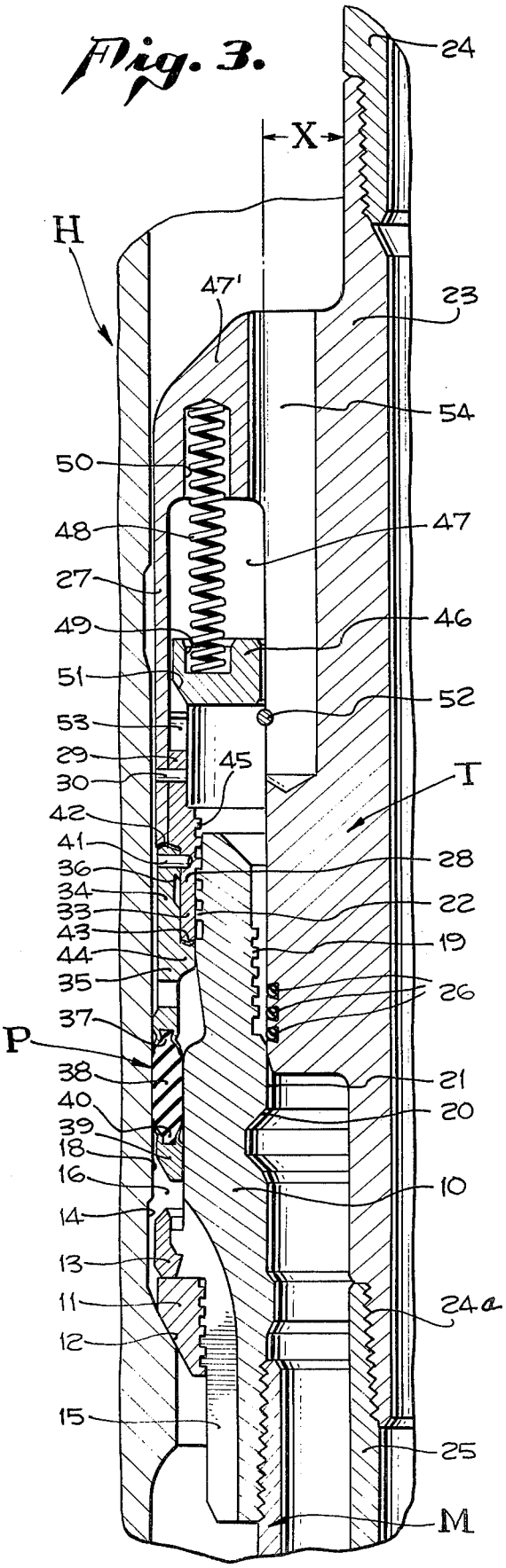
FIG. 3 is a view similar to FIG. 2, but showing the assembly initially landed between the wellhead housing and the casing hanger.

As seen in FIG. 3, continued downward movement of the apparatus causes the lower thread 45 on the nut 28 to land on the upper thread 22 of the casing hanger 10.

Figure 4:
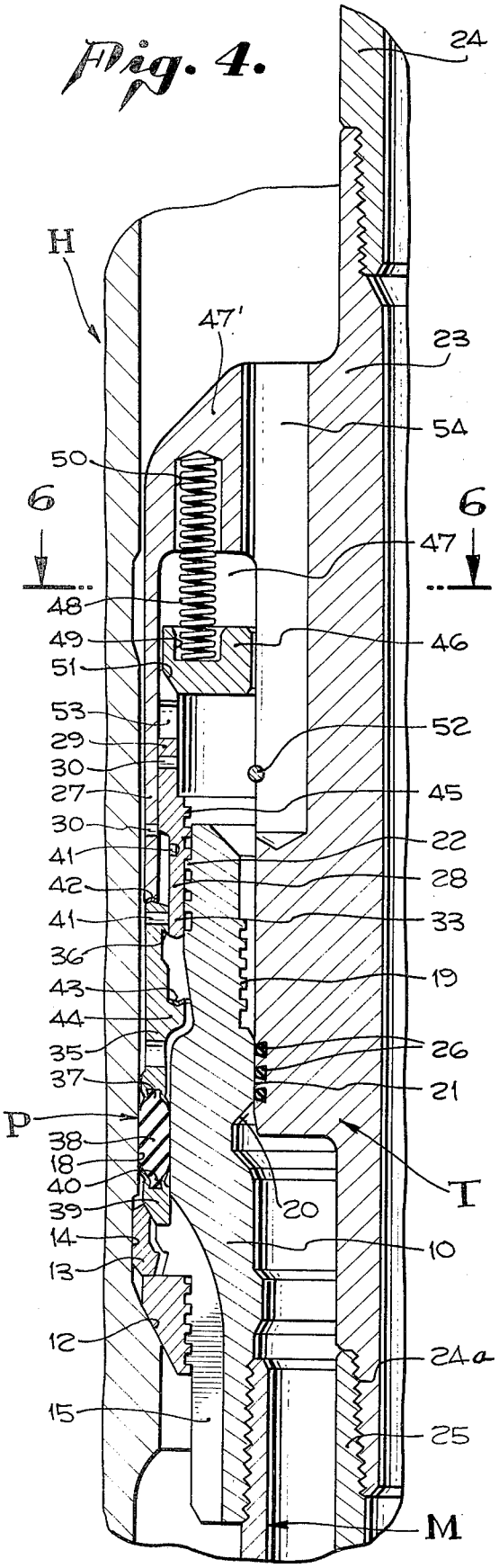
FIG. 4 is another view similar to FIGS. 2 and 3, but showing the packing initially set in sealing engagement between the wellhead housing and the casing hanger.
Figure 8:
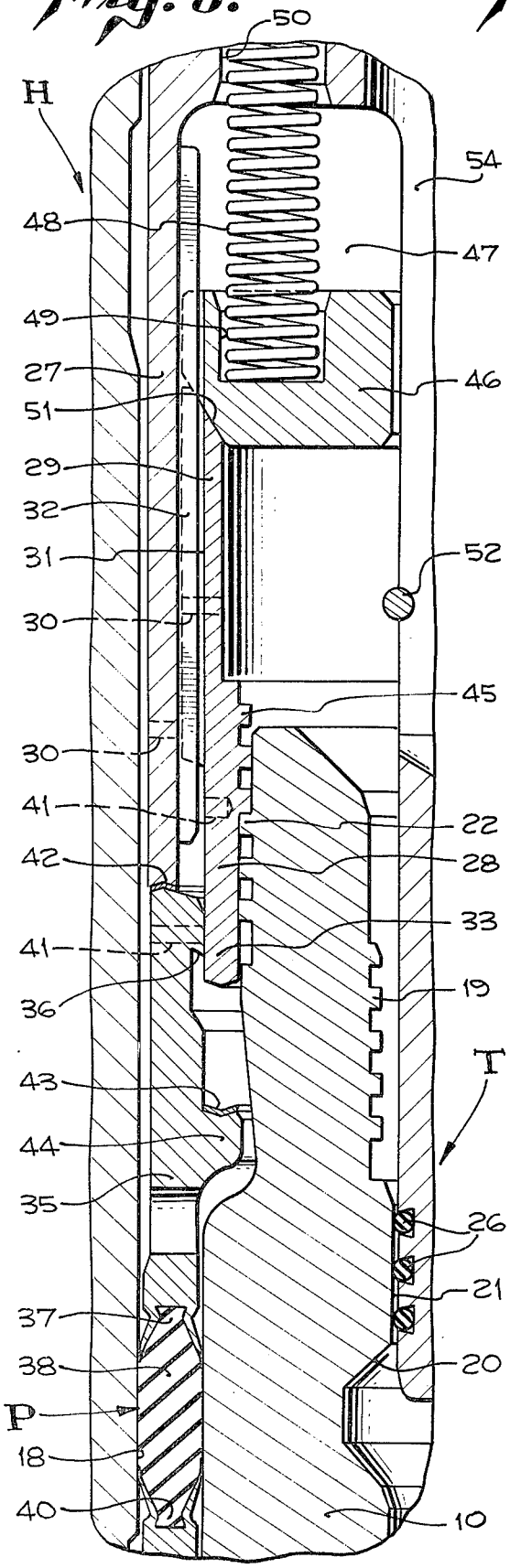
FIG. 8 is an enlarged section as taken on the line 8 through 8 of FIG. 6 showing the packing initially packed off.

Therefore, as seen in FIGS. 4 and 8, as the tool T moves further downwardly, under the weight of the running string 24 and the weight string 25, the shear pins 30 and 41 are sheared as the skirt 27 of the tool body pushes downwardly on the packing support sleeve 35, thus moving the packing 38 into the annulus 16 to deform it radially into sealing engagement with the opposed cylindrical walls 17 and 18 of the casing hanger and the housing H, respectively. Also, in response to such downward movement of the tool body, the lower expander ring 39 on the packing 38 engages and causes the lock ring 13 to be expanded outwardly into the locking groove 14, to lock the casing hanger 10 against upward movement.

At this time, the blowout preventer rams can be closed on the running string 24 and fluid under pressure can be supplied from the drilling vessel through the usual choke and kill line of the blowout preventer to test the efficiency of the seal. Such fluid pressure also acts on the differential tool area X (See FIG. 3) between the seals 26 in the hanger 10 and the sealing diameter of the blowout preventer rams on the running string to provide a further downward force to move and tightly set the packing in place in the annulus 16.

Figure 5:
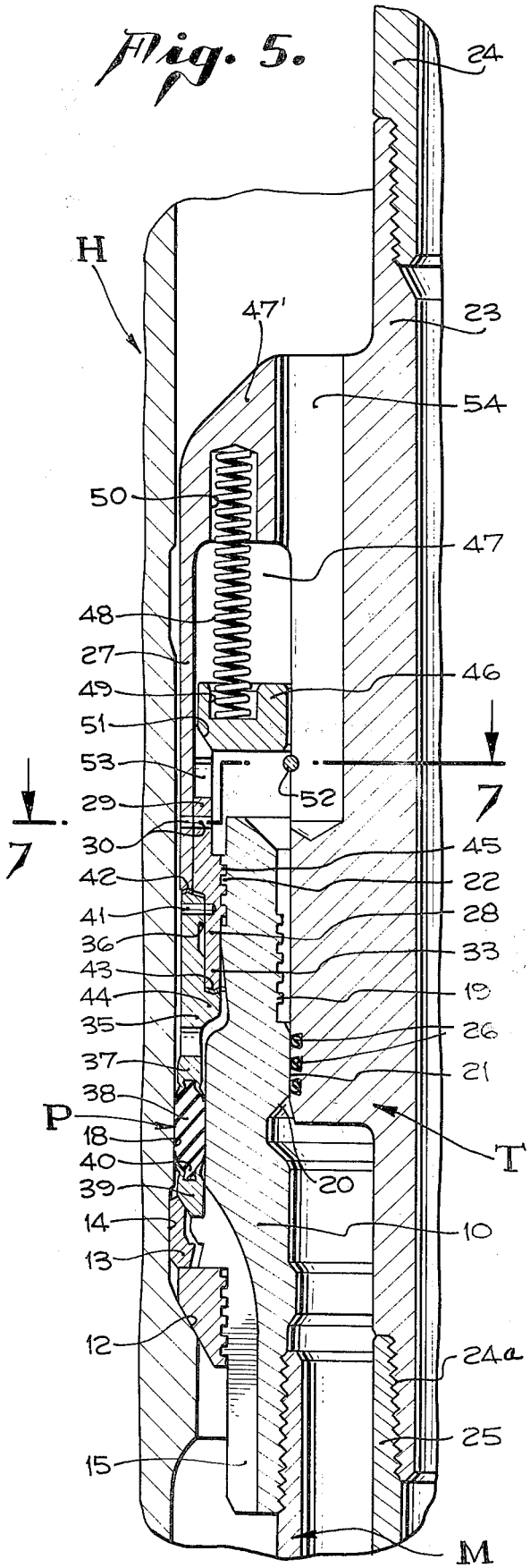
FIG. 5 is still another view similar to FIGS. 2 through 4, but showing the packing locked in place.
Figure 9:
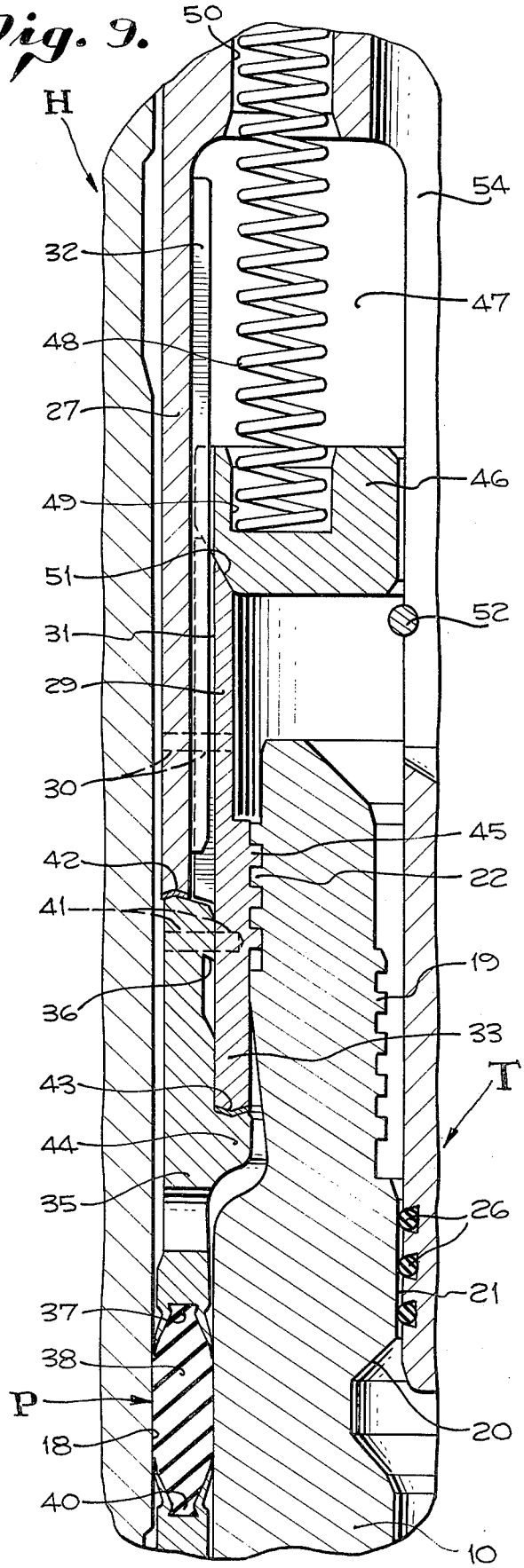
FIG. 9 is a view similar to FIG. 8, but showing the packing locked in place responsive to rotation of the running tool.

Next, as seen in FIGS. 5 and 9, the running string is rotated so that the locking nut 28 is correspondingly rotated through the splined connection 31, 32 to engage the thread 45 of the locking nut with the thread 22 of the casing hanger. Initial threaded engagement is assured by the downward force applied to the nut by the bias springs 48.

The running string and tool are then retrieved to the vessel, leaving the packing P locked in place.

Accordingly, it will now be seen that the present invention provides novel and simple, yet effective, apparatus for running, weight setting and torque locking the packing unit in place between the housing and the casing hanger.

I claim:

1. Underwater apparatus for forming a seal in an annulus between a subsurface wellhead housing and a casing hanger seated in said housing, locking packing means for forming a seal in said annulus, lockking means for locking said packing means in said annulus, and running tool means connectable to a running string for setting said packing means in said annulus and operating said locking means, said running tool means including a body connectable to said running string, means releasably connecting said locking means and said packing means to said body, said locking means including means engageable with the casing hanger, actuator means on said body responsive to the weight of said running string for releasing said releasable means upon initial engagement of said locking means with the casing hanger and for setting said packing means in said annulus, and means on said setting tool for actuating said locking means into locked engagement with said casing hanger.

2. Underwater wellhead apparatus as defined in claim 1, wherein said body has seal means engageable with said casing hanger to form a differential area responsive to pressure above said packing means to force said body to more tightly set said packing.

3. Underwater wellhead apparatus as defined in claim 1, wherein said releasable means include first shearable means connecting said locking means to said actuator means and second shearable means connecting said packing means to said locking means.

4. Underwater wellhead apparatus as defined in claim 1, wherein said releasable means include first shearable means connecting said locking means to said actuator means and second shearable means connecting said packing means to said locking means, said locking means including a threaded nut, and said means for actuating said locking means including rotary drive means between said actuator means and said nut.

5. Underwater wellhead apparatus as defined in claim 1, wherein said releasable means include first shearable means connecting said locking means to said actuator means and second shearable means connecting said packing means to said locking means, said locking means including a threaded nut and said means for actuating said locking means including rotary drive means between said actuator means and said nut, said rotary drive means including a longitudinally extended splined connection between said actuator means and said nut.

6. Underwater wellhead apparatus as defined in claim 1, wherein said releasable means include first shearable means connecting said locking means to said actuator means and second shearable means connecting said packing means to said locking means, said locking means including a threaded nut and said means for actuating said locking means including rotary drive means between said actuator means and said nut, said rotary drive means including a longitudinally extended splined connection between said actuator means and said nut, and further including spring means biasing said nut towards engagement with said casing hanger.

7. Underwater wellhead apparatus as defined in claim 1, wherein said releasable means include first shearable means connecting said locking means to said actuator means and second shearable means connecting said packing means to said locking means, said locking means including a threaded nut and said means for actuating said locking means including rotary drive means between said actuator means and said nut, and also including bearing means between said nut and said packing means.

8. Underwater wellhead apparatus as defined in claim 1, wherein said releasable means include first shearable means connecting said locking means to said actuator means and second shearable means connecting said packing means to said locking means, said locking means including a threaded nut and said means for actuating said locking means including rotary drive means between said actuator means and said nut, and also including bearing means between said nut and said packing means, and bearing means between said actuator means and said packing means.

9. Underwater wellhead apparatus as defined in claim 1, wherein said packing means includes a support sleeve, a resilient deformable packing sleeve carried beneath said support sleeve, said locking means including a threaded nut engageable with said casing hanger, and said releasable means including shearable means connecting said support sleeve with said nut and shearable means connecting said nut with said actuator means.

10. Underwater wellhead apparatus as defined in claim 1, wherein said packing means includes a support sleeve, a resilient deformable packing sleeve carried beneath said support sleeve, said locking means including a threaded nut engageable with said casing hanger, and said releasable means including shearable means connecting said support sleeve with said nut and shearable means connecting said nut with said actuator means, said actuator means and said nut housing a splined rotary drive connection whereby said nut can move longitudinally of said body while being rotated.

11. Apparatus for forming a seal in an annulus between an underwater wellhead housing and a casing hanger installed therein comprising: a running tool having a body connectable to a running pipe string to be lowered thereby into the housing, said body having an actuator portion, packing means actuatable to form a seal between the housing and casing hanger, packing locking means for locking said packing in sealing condition, first shearable means connecting said packing locking means to said actuator portion, second shearable means connecting said packing means to said locking means, said actuator portion being engaged with said packing means to shear said shearable means upon movement of said body when said locking means initially engages said casing hanger to prevent movement of said locking means with said body.

12. Apparatus as defined in claim 11, wherein said packing locking means includes a nut threadedly engageable with said casing hanger, and said actuator portion and said nut have campanion rotary drive means for rotating said nut and allowing longitudinal movement of said nut.

13. Apparatus as defined in claim 11, wherein said packing locking means includes a nut threadedly engageable with said casing hanger, and said actuator portion and said nut have campanion rotary drive means for rotating said nut and allowing longitudinal movement of said nut, and including bearings between said nut and said packing means and between said actuator portion and said packing means.

14. Apparatus as defined in claim 11, wherein said body has a sealing portion engageable in said casing hanger and larger than the running string to provide a differential area responsive to fluid pressure to move said actuator portion in a direction to actuate said packing means to form a seal.

15. Apparatus as defined in claim 11, wherein said packing locking means includes a nut threadedly engageable with said casing hanger, and said actuator portion and said nut have campanion rotary drive means for rotating said nut and allowing longitudinal movement of said nut, and spring means between said body and said nut for biasing said nut towards said casing hanger.

16. Apparatus as defined in claim 11, wherein said packing means includes a support sleeve, said support sleeve having an abutment shoulder therein, said packing locking means comprising a nut engaged with said shoulder and having a thread engageable with a companion thread on said casing hanger.

17. Apparatus as defined in claim 11, wherein said packing means includes a support sleeve, said support sleeve having an abutment shoulder therein, said packing locking means comprising a nut engaged with said shoulder and having a thread engageable with a companion thread on said casing hanger, said actuator portion engaging said support sleeve.

18. Apparatus as defined in claim 11, wherein said packing means includes a support sleeve, said support sleeve having an abutment shoulder therein, said packing locking means comprising a nut engaged with said shoulder and having a thread engageable with a companion thread on said casing hanger, said actuator portion engaging said support sleeve, said body also having spring means acting on said nut to bias said nut in a direction for engagement with said companion thread of said casing hanger.

19. Apparatus as defined in claim 11, wherein said body is an elongated member having an enlarged sealing section sealingly engageable in said casing hanger, said actuator portion comprising a skirt on said body, said packing means having a packing support sleeve engaged by said skirt, said packing locking means comprising a nut having a thread engageable with a companion thread on said casing hanger, said nut and said support sleeve having abutting portions, said first shearable means connecting said nut to said skirt, said second shearable means connecting said support sleeve to said nut.

20. Apparatus as defined in claim 11, wherein said body is an elongated member having an enlarged sealing section sealinglyengageable in said casing hanger, said actuator portion comprising a skirt on said body, said packing means having a packing support sleeve engaged by said skirt, said packing locking means comprising a nut having a thread engageable with a companion thread on said casing hanger, said nut and said support sleeve having abutting portions, said first shearable means connecting said nut to said skirt, said second shearable means connecting said support sleeve to said nut, said body and said skirt defining an annular space therebetween, a thrust ring in said annular space engaged with said nut, and spring means in said annular space acting between said thrust ring and said body to force said thrust ring and said nut towards said companion thread on said casing hanger upon shearing of said shearable means.

* * * * *